United States Patent [19]

Perry

[11] 3,976,319

[45] Aug. 24, 1976

[54] TOBACCO RACK

[76] Inventor: Arthur Lee Perry, 118 S. Carolina St., Goldsboro, N.C. 27530

[22] Filed: Nov. 12, 1975

[21] Appl. No.: 630,969

[52] U.S. Cl. ..... 294/5.5
[51] Int. Cl.[2] ..... A24B 1/08
[58] Field of Search ..... 294/5.5; 56/27.5; 211/59, 123, 124, 125; 214/5.5

[56] References Cited

UNITED STATES PATENTS

| | | | |
|---|---|---|---|
| 3,244,445 | 4/1966 | Wilson | 294/5.5 |
| 3,767,248 | 10/1973 | Horne | 294/5.5 |
| 3,807,782 | 4/1974 | Taylor et al. | 294/5.5 |

*Primary Examiner*—Johnny D. Cherry
*Attorney, Agent, or Firm*—Bennett A. Brown

[57] ABSTRACT

This device is a rack for holding tobacco leaves while they are being cured. The rack includes two frame elements which, in their operative position, engagingly support a large bulk of individual tobacco leaves. A first frame element, in the shape of a square — U, carries telescoping arms which are to be inserted in the guide means of a second frame element. Parallel to these arms and extending from the base of the U of the first frame element are elongated, sharpened, piercing rods which penetrate the tobacco leaves. Cooperative fastening means are found at each end of the base of the first frame element which cooperate with the latching means on the second element to maintain the frame in its operative position. The second frame element provides guide means and support for the first frame element. Also the second frame element has a latching means thereon.

6 Claims, 3 Drawing Figures

FIG. 1
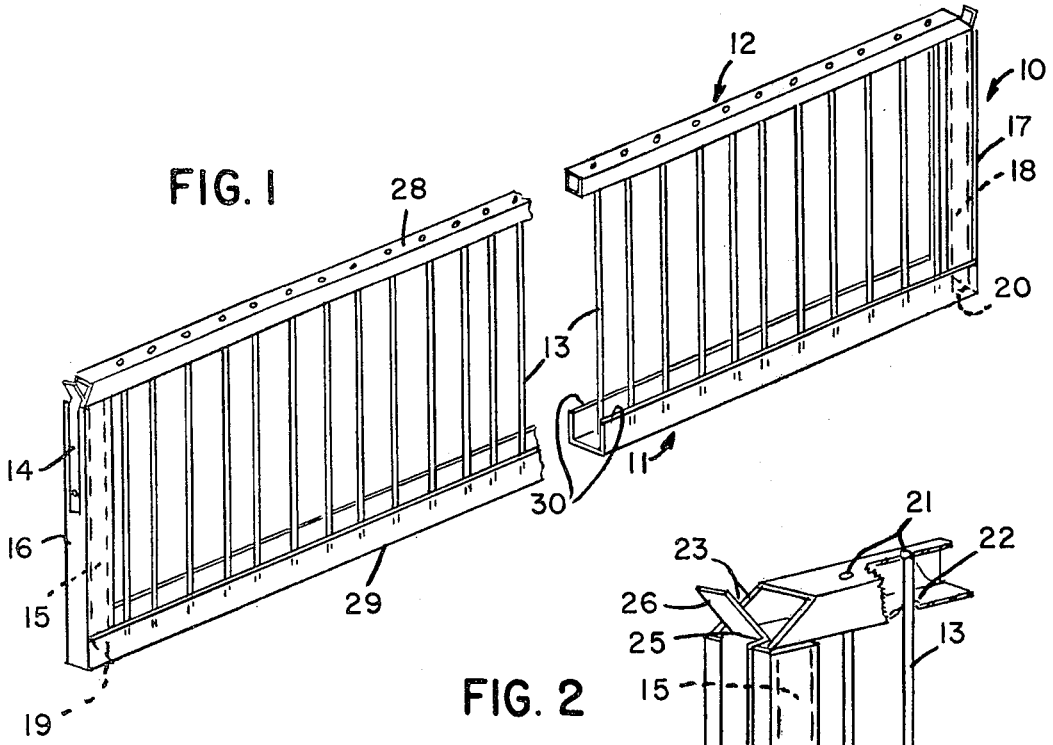
FIG. 2
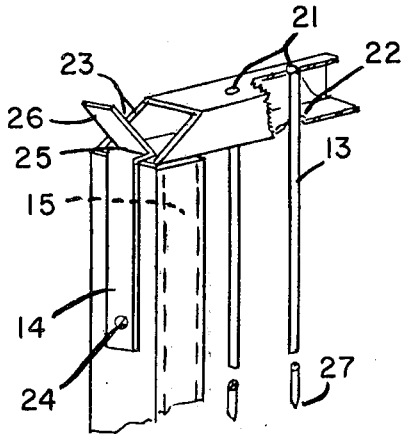
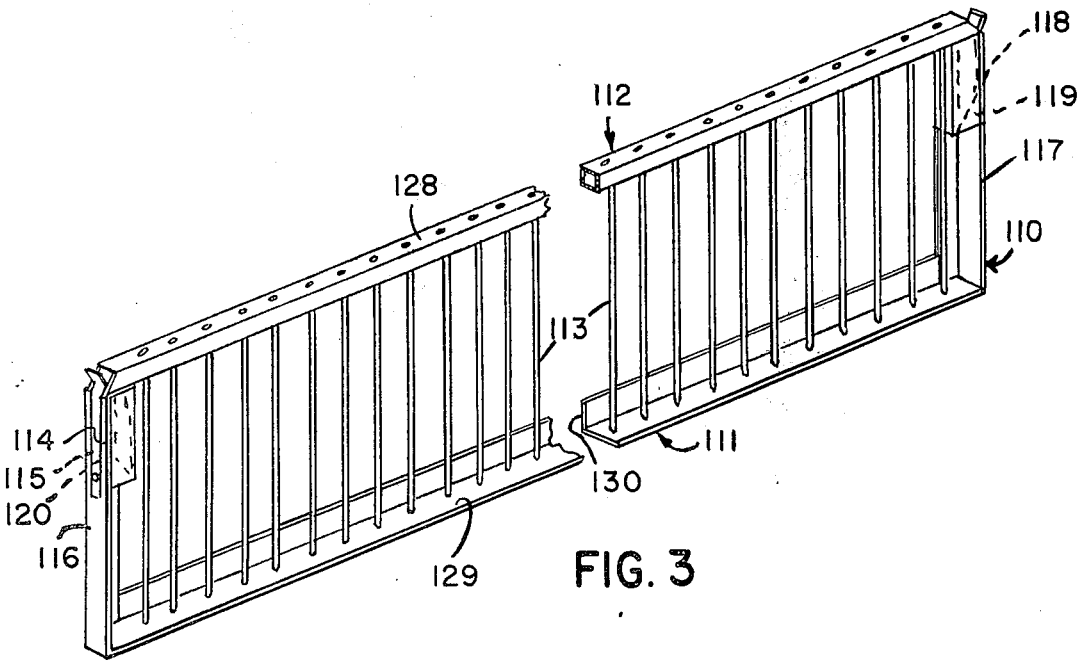
FIG. 3

TOBACCO RACK

BACKGROUND OF THE INVENTION

1. Field of the Invention

This invention relates to a tobacco rack for holding tobacco leaves during curing. During the curing of tobacco, the green tobacco leaves are allowed to hang suspended from racks in tobacco curing barns. The tobacco leaves are said to be cured when they have remained in the curing barns for a sufficient period to reach the desired crispness. At this time the tobacco is removed from the barn and the racks, graded, packed, and shipped to the tobacco market.

All of these operations are hand operations involving great numbers of man-hours. To reduce the requirement that each leaf be impaled, by hand, on a stick or string, new devices, such as the instant device, have been utilized. These racks permit a large quantity of individual tobacco leaves to be racked at one time in one simple operation whereby the tobacco leaves are simultaneously impaled by simply joining the two elements of the new tobacco curing racks.

2. Description of the Prior Art

For decades, the Bright Leaf tobacco leaves were cured by stringing or "lopping" the tobacco leaves on tobacco strings or sticks and suspending these strings or sticks on uniformly spaced horizontal "tier poles". These tier poles were anchored to the interior of the curing barn at various levels from the ground floor to the rafters.

Subsequently, various other forms of tobacco racks were developed, such as the racks shown in U.S. Pat. No. 3,134,583; U.S. Pat. No. 3,244,445; and U.S. Pat. No. 3,767,248. The prior art racks are bulky, heavy and expensive. They require electric hoists to remove them from the field trailer and place them in the tiers in the curing barns. This requires extra labor.

SUMMARY OF THE INVENTION

The present invention presents an improvement over the prior art in that this tobacco rack utilizes relatively lightweight, simple, economical materials and fabrication while providing an improved, highly effective, and stronger tobacco supporting rack. The construction is of square steel tubing and angle steel to provide added strength and durability,. The rack elements may be assembled and disassembled by the touch of a thumb at each end of the rack thereby operating the very simple latching mechanism.

These and other advantages of the present invention will be seen upon viewing the accompanying figures and reading the description thereof contained in the specification.

BRIEF DESCRIPTION OF THE DRAWINGS

FIG. 1 is a perspective view of the rack assembly according to the present invention in the assembled state, partly in cross section; FIG. 2 is a fragmentary perspective view, partially in cross section, of the rack elements in their assembled and latched state particularly showing the latching mechanism and piercing rods; FIG. 3 is a fragmentary perspective view of the rack elements in their assembled state and illustrating a modification of the guiding means, partly in cross section.

DETAILED DESCRIPTION OF THE PREFERRED EMBODIMENTS

The preferred embodiment of the present invention will now be described with reference to the drawings. As shown in FIG. 1, the tobacco rack 10, according to the present invention, is made up of a first rack section 12 and a second rack section 11. The rack sections 11 and 12 are constructed in such a manner as to be removably assembled together to retain tobacco leaves within the two sections by means of the piercing rods.

Rack section 12 is made of one inch square thin wall steel tubing. Rack element 12 is in the shape of a square — U with a base member 28 and two parallel arm members, one at each end of the base member. The square tubing of the base member 28 is apertured at uniformly spaced points throughout its length.

The apertures 22 allow the piercing rods to be inserted through the base member 28 in the same direction and parallel with the arm members. Each piercing rod is supported at the two points on the base member defining the edges of each aperture. On the outer surface, i.e., the top surface shown in FIG. 1, the piercing rod is welded to the base member using a plug weld thereby forming a smooth and strong connection between the base member and the piercing rods.

At each end of the base member 28 arm members 15 and 18, respectively are welded thereto at right angles to the base member and extending parallel to the piercing rods.

Each end of the base member is cut on a 45° angle. This angle is arranged so that the outer surface of the base member is shorter than the inner surface of the base member. This configuration forms part of the latching mechanism. When the rack elements 11 and 12 are assembled, the spring latch 14 will force the retainer portion 25 over the inner surface of base member 28 thereby holding the elements 11 and 12 in the assembled condition. This configuration also allows the operator to place his hands on the base member and operate the latching mechanism to disengage retainer portion 25 from the base member by exerting force on the exposed tang 26 of the latch. By merely exerting pressure in the gap between the angled end of the base member 28 and the tang 26, the latch is opened. Disassembly is thereby facilitated even though tang 26 is shortened so that it does not extend past the plane of the outer surface of the rack.

The arm members 15 and 18 of element 12 are each made of square thin wall tubing having the same circumferential dimensions as the base member. Each arm is welded to the end of the base member with a box weld which provides a strong rigid connection. Each arm extends in the same direction as the piercing rods and parallel thereto. The arms 15 and 18 are slightly longer than the piercing rods. The extra length of the arms provides a stop means when elements 11 and 12 are assembled which prevents the points 27 on the ends of the piercing rods from contacting element 11.

The ends of the arms 15 and 18 are cut on a 45° angle. This 45° slope 19 and 20 serves as a guide. Immediately before elements 11 and 12 are assembled, as shown in FIG. 1, arms 15 and 18 of element 12 are brought in contact with the upper ends of the legs 16 and 17 of element 11. The 45° cuts 19 and 20 on arms 15 and 18, respectively, allow the initial insertion of the arms 15 and 18 into the legs 16 and 17 without interference or pressure from the spring latch 14. Once the initial insertion has taken place, the elements 11 and 12 may be fully assembled, as shown in FIG. 1, by forcing the arms 15 and 18 to telescope within the legs 16 and 17.

The other rack element 11 is formed as a square — U having the same general dimensions as element 12 only slightly larger. The base member 29 of the element 11 is channel-shaped. At each end of the base member 29 there is a leg member 16 and 17, respectively. The legs 16 and 17 are perpendicular to the base member 29 and are each welded to the base member 29. The legs are made from thin wall tubing which is 1¼ inch on each side. Each leg is placed within the channel of member 29 and rests on the web thereof. This allows the flanges of the channel member 29 to extend along the outer surfaces of the square tubing of legs 16 and 17. The flanges 30 provide additional support and rigidity to the welded connection between the element 29 and the legs 16 and 17. Further, the flanges 30 provide a supporting surface for the piercing rods 13 when the rack is loaded with tobacco leaves and placed in its operative curing position.

The leg members 16 and 17 are of the same length as arm members 15 and 18. Referring to FIG. 2, there is shown a spring latch 14, one on each leg, composed of a 5-inch spring steel latch member. The spring latch 14 is secured to its respective leg member at 24 by any conventional securement means, e.g., bolt, rivet, or a weld. The spring latch 14 extends along the outer surface of each leg from its point of securement 24 to the end of the respective leg. The spring latch extends a short distance past the end of the respective legs 16 and 17 where latching portion 25 is formed. Latching portion 25 consists of an inward crimp in spring latch 14 whereby the spring latch 14 is formed with a 90° angle which extends the spring latch inwardly over the tubular opening in legs 16 and 17. The spring latch portion 25 is then formed with an acute interior angle which produces tang 26. Tang 26 forms the operative surface by which the latching mechanism is manipulated.

FIG. 3 shows a modified form of the tobacco curing rack described above. The modified rack 110 is composed of two rack elements 111 and 112 corresponding to elements 11 and 12 described above.

Element 112 has a base member 128 and arm members 115 and 118 welded at each end thereof. These elements are square thin wall steel tubing. Base member 128 is formed with the 45° angle arranged end portions which cooperate with the spring latch 114 to hold the rack elements in their operative position.

This configuration is the same as used in the latching mechanism detailed above.

Arm members 115 and 118 of element 112 are each made of square thin walled tubing having the same circumferential diameter as the base member. Each arm is welded to the end of the base member with a box weld and each arm extends in the same direction as the piercing rods. The arms 115 and 118 are foreshortened to the extent that they are approximately one-third the length of the piercing rods 113. These modifications allow a reduction in weight of the device while maintaining the necessary guide means. The ends of the arms 115 and 118 are cut on a 45° angle 119 and 120 which correspond to the elements 19 and 20 described above.

The other rack element 111 is formed as a square — U having the same general dimensions as element 112 only slightly larger. The modified rack element 111 is formed from angle-steel rather than the channel shape used in base member 29. The use of angle-steel rather than channel shape steel affords a further reduction in weight. At each end of the base member 129 there is a leg member 116 and 117, respectively. The legs 116 and 117 are perpendicular to the base member and are each welded to the base member. At the outer ends of leg members 116 and 117 there are square tubing portions. These square tubing portions extend from the end of each leg toward the base member 129 for approximately one-third the total length of the leg 116 and 117, respectively. This length of square tubing corresponds to the length of the square tubing arms 115 and 118 of rack element 112. In this modification the angle-steel of base member 129 creates only one flange 130 which will act as a support for the ends of piercing rods 113 when the rack is in its operative position.

The leg members 116 and 117 are provided with a spring latch member 114, one on each leg, such as described above in relation to spring latch 14.

There are other changes and modifications that can be made to the subject embodiment within the scope of this invention.

What is claimed is:

1. A rack for supporting a mass of tobacco leaves for facilitating transporting and curing the leaves, said rack comprising:

a. A first rack element substantially U-shaped with a base portion and two arm portions, said base portion and said arm portions being formed of square steel tubing, b. Said base portion having uniformly spaced perforations along the length thereof, elongated piercing rods extending from each of said uniformly spaced perforations in the same direction and parallel to said leg portions, c. Each of said piercing rods having one end disposed in said uniformly spaced perforations and attached to said base portion, the other ends of said piercing rods being sharpened to a point, said piercing rods and said arm portions being of different lengths, d. Said arm portions each being affixed to said base portion at one end thereof with the other free end terminating in an angled plane formed by a 45° sloped end, said 45° sloped end forming a guide means at the free end of each arm portion, e. Said base portion having ends formed in a 45° angled slope to form a cooperating part of a latching mechanism, and f. A second rack element comprised of a base portion and two leg portions, one each extending from each end of said base portion, to form a U-shape, g. Said leg portions being formed from square steel tubing and having a free end carrying a spring latch mechanism along the outer surface thereof, the other end being affixed to the base portion, h. said base portion of said second rack element being formed of channel shaped lightweight steel of such dimensions that the said other ends of said leg portions rest on and are affixed to the web of the said base portion, i. Said arm portions of said first rack element being telescoped within the said leg portions of said second rack element when the tobacco rack is in the assembled position, j. Said spring latch mechanism cooperating with the sloped ends of said base portion of said first rack element to resiliently hold the tobacco rack in its assembled condition.

2. A tobacco rack as claimed in claim 1, wherein said spring latch is formed comprising a spring steel elongated thin plate attached to said leg portion at one end and extending along the outer surface of said leg portion a substantial distance, the other end of said spring latch being formed in a 90° angle inwardly over the end of said leg portion then extending outwardly in a 45° angle to form an operating tang, said 90° angled portion resting within the bore of the base portion of the first rack element when the tobacco rack is in its assembled condition.

3. A rack as claimed in claim 2, wherein each piercing rod is affixed within each perforation by a plug weld, each leg portion and each arm portion is affixed to its respective base portion by a box weld.

4. A tobacco rack as claimed in claim 3, wherein said second rack element is formed of angle steel, said leg portions having a box tubing portion at the free end thereof with the substantial length of each leg member being formed of angle steel.

5. A tobacco rack as claimed in claim 4, wherein the arm portions of said first rack element are much shorter than the said piercing rods carried by said first rack element.

6. A tobacco rack as claimed in claim 3, wherein the said arm portions of said first rack element are each approximately one-third as long as the piercing rods carried by the base portion of said first rack element.

* * * * *